US009759205B2

(12) United States Patent
Kiehlneker

(10) Patent No.: US 9,759,205 B2
(45) Date of Patent: Sep. 12, 2017

(54) TEMPERATURE DETECTION METHOD IN A HYDRAULIC ARRANGEMENT

(71) Applicant: GETRAG Getriebe—und Zahnradfabrik Hermann Hagenmeyer GmbH & Cie KG, Untergruppenbach (DE)

(72) Inventor: Alexander Kiehlneker, Flein (DE)

(73) Assignee: GETRAG GETRIEBE—UND ZAHNRADFABRIK HERMANN HAGENMEYER GMBH & CIE KG, Untergruppenbach (DE)

( * ) Notice: Subject to any disclaimer, the term of this patent is extended or adjusted under 35 U.S.C. 154(b) by 0 days.

(21) Appl. No.: 13/968,305

(22) Filed: Aug. 15, 2013

(65) Prior Publication Data

US 2014/0050592 A1 Feb. 20, 2014

(30) Foreign Application Priority Data

Aug. 16, 2012 (DE) ..... 10 2012 016 591

(51) Int. Cl.
*F04B 19/00* (2006.01)
*F15B 19/00* (2006.01)
*F04B 17/00* (2006.01)

(52) U.S. Cl.
CPC ..... *F04B 17/00* (2013.01); *F15B 19/005* (2013.01); *F15B 2211/20515* (2013.01);
(Continued)

(58) Field of Classification Search
CPC ..... F04B 17/00; F15B 19/005; F15B 2211/40507; F15B 2211/41563;
(Continued)

(56) References Cited

U.S. PATENT DOCUMENTS 4,248,194 A * 2/1981 Drutchas et al. ..... 123/357
6,454,540 B1 * 9/2002 Terefinko ..... A62C 5/02 169/13
(Continued)

FOREIGN PATENT DOCUMENTS

CN 1711428 A 12/2005
DE 100 11 801 A1 2/2001
(Continued)

OTHER PUBLICATIONS

Machine translation of Abstract of FR2925674 dated Jun. 2009.*
(Continued)

*Primary Examiner* — Nathan Zollinger
(74) *Attorney, Agent, or Firm* — Knobbe Martens Olson & Bear LLP

(57) ABSTRACT

Method for determining the temperature of a fluid in a hydraulic arrangement for a motor vehicle. The hydraulic arrangement has a pump arrangement, which is driven by means of a drive motor, and a pressure sensor, which is connected to a discharge port of the pump arrangement and is used to measure the pressure of the fluid. The pump arrangement is connected to a tank via a leakage point. The temperature of the fluid is determined on the basis of a relationship between a state variable of the drive motor and the temperature of the fluid at a predetermined pressure of the fluid, said relationship being specific to the hydraulic arrangement.

9 Claims, 2 Drawing Sheets

(52) U.S. Cl.
CPC ..... *F15B 2211/20538* (2013.01); *F15B 2211/40507* (2013.01); *F15B 2211/41563* (2013.01); *F15B 2211/633* (2013.01); *F15B 2211/6309* (2013.01); *F15B 2211/66* (2013.01); *F15B 2211/6651* (2013.01)

(58) Field of Classification Search
CPC ..... F15B 2211/6309; F15B 2211/66; F15B 2211/20515; F15B 2211/20538; F15B 2211/633; F15B 2211/6651; B60T 8/4036; B60T 8/404; B60T 8/4054; B60T 8/18; B60T 8/20
USPC ..... 417/32, 44.1, 53, 364; 702/99, 130, 136; 60/459, 431
See application file for complete search history.

(56) References Cited

U.S. PATENT DOCUMENTS 6,729,849 B2 * 5/2004 Fong ..... F04B 49/022 417/44.2
7,207,173 B2 * 4/2007 Nakata ..... F15B 21/042 374/E3.007
2004/0159520 A1 8/2004 Anwar et al.
2006/0150621 A1 7/2006 Nakata et al.

FOREIGN PATENT DOCUMENTS

| | | | | |
|---|---|---|---|---|
| DE | 696 28 529 | T2 | | 4/2004 |
| EP | 1 574 723 | A1 | | 9/2005 |
| FR | 2925674 | A3 | * | 6/2009 |
| GB | 2 430 473 | A | | 3/2007 |
| JP | 2002-029667 | A | | 1/2002 |
| JP | 2002029667 | A | * | 1/2002 |

OTHER PUBLICATIONS

Cholet, Progressive Cavity Pumps, pp. 44, 1997.*
Chinese Office Action dated Apr. 25, 2016 for CN Application No. 201310352845.2.

* cited by examiner

TEMPERATURE DETECTION METHOD IN A HYDRAULIC ARRANGEMENT

CROSS-REFERENCE TO RELATED APPLICATIONS

This application claims the priority of German patent application DE 10 2012 016 591.9, filed on Aug. 16, 2012.

BACKGROUND

The present invention relates to a method for determining the temperature of a fluid in a hydraulic arrangement for a motor vehicle.

The present invention furthermore relates to a hydraulic arrangement for a motor vehicle, having a pump arrangement, which is driven by means of a drive motor, having a pressure sensor, which is connected to a discharge port of the pump arrangement, wherein the pump arrangement is connected to a tank via a leakage point, and having a control unit, which is connected to the pressure sensor.

In the area of hydraulic arrangements for motor vehicles, the practice of connecting a pump to a power takeoff of an internal combustion engine is known. In this case, a discharge port of the pump is connected to a pressure control valve, by means of which a predetermined line pressure is generated. Respective control pressures for controlling actuators and the like are then derived from said line pressure by means of suitable additional valves.

Hydraulic arrangements of the abovementioned type in which a pump of a pump arrangement is driven by a drive motor in the form of an electric motor are furthermore known. In this case, a discharge port of the pump is preferably connected directly, i.e. without the interposition of pressure control valves or other proportional valves, to a port of an actuator, such as a piston/cylinder arrangement. The discharge port is furthermore connected to a pressure sensor. By adjusting the rotational speed of the drive motor, the fluid pressure of the hydraulic actuator and hence, for example, an actuating force for actuating a clutch of a motor vehicle drive train or the like can be adjusted. This is preferably accomplished by means of a control operation in which the rotational speed is adjusted as a function of the signal of the pressure sensor.

In order to improve controllability in the case of "pump actuators" of this kind, the discharge port of the pump is furthermore connected to the tank via a leakage point. This leakage point can be implemented by means of an orifice plate, for example.

The fluid used in hydraulic arrangements of this kind has a viscosity which is dependent on temperature. In order to further improve the controllability of the hydraulic arrangement, the preference is therefore for measuring the temperature of the fluid by means of a temperature sensor.

SUMMARY

Given this background situation, it is an object of the invention to specify an improved method for determining the temperature of a hydraulic arrangement and to specify a hydraulic arrangement of the type designated above which, in particular, can be implemented at low cost and/or has a high level of redundancy.

On the one hand, the above object is achieved by a method for determining the temperature of a fluid in a hydraulic arrangement for a motor vehicle, wherein the hydraulic arrangement has a pump arrangement, which is driven by means of a drive motor, and a pressure sensor, which is connected to a discharge port of the pump arrangement and is used to measure the pressure of the fluid, and wherein the pump arrangement is connected to a tank via a leakage point, wherein the temperature of the fluid is determined on the basis of a relationship between a state variable of the drive motor and the temperature of the fluid at a predetermined pressure of the fluid, said relationship being specific to the hydraulic arrangement.

The above object is furthermore achieved by a hydraulic arrangement for a motor vehicle, having a pump arrangement, which is driven by means of a drive motor, having a pressure sensor, which is connected to a discharge port of the pump arrangement, wherein the pump arrangement is connected to a tank via a leakage point, and having a control unit, which is preferably designed for carrying out the method according to the invention, wherein the control unit is connected to the pressure sensor and wherein the control unit determines the temperature of the fluid on the basis of a relationship between a state variable of the drive motor and the temperature of the fluid at a predetermined pressure of the fluid, said relationship being specific to the hydraulic arrangement.

In hydraulic arrangements of the type described above, there is a clear relationship between the pressure of the fluid and the state variable of the drive motor. This relationship is dependent on the viscosity of the fluid and hence on the temperature thereof.

A clear relationship of this kind can be present, in particular, in the case of "pump actuators", where a discharge port of a pump arrangement is connected directly, i.e. without the interposition of pressure control valves or other proportional valves, to the input of a hydraulic actuator.

The leakage point is preferably implemented in such a way that the leakage function thereof is dependent on temperature.

Accordingly, the temperature of the fluid can be inferred from the relationship between the pressure and the state variable of the drive motor.

At the same time, the temperature detection can have a relatively high tolerances, e.g. +2.5° C. or preferably ±5° C. However, for applications in motor vehicles, especially in clutch/transmission arrangements, this is generally an adequate way of determining the temperature.

Accordingly, the method according to the invention or the hydraulic arrangement according to the invention can be used to determine the temperature of the fluid without having to provide a separate temperature sensor for this purpose. Consequently, it is possible to eliminate the costs for a temperature sensor of this kind and the costs for the wiring of a temperature sensor of this kind. Moreover, there is a higher level of fail safety and higher efficiency since it is possible to dispense with an electronic component in the form of a temperature sensor, and there is no need to install such a component.

Thus, the object is fully achieved.

In general, it is possible to predetermine or specify the relationship between the state variable and the temperature for a particular type of hydraulic arrangement.

However, since hydraulic arrangements of the design used are subject to certain installation tolerances and play, it is preferred if the relationship, specific to the hydraulic arrangement, between the state variable and the temperature is determined for at least one predetermined pressure before initial commissioning of the hydraulic arrangement and/or in the context of maintenance of the hydraulic arrangement.

Since it is generally necessary in any case to characterize the possible scatter in the production process by means of boundary components (axial play, radial play, head clearance in the pump and/or possible effects of excessive/inadequate eccentricity, to name a few examples), the functional test carried out in this regard during commissioning can also be extended by the step of determining the relationship, specific to the hydraulic arrangement already produced, between the state variable and the temperature.

Moreover, such tolerances may change during the operation of the hydraulic arrangement. Consequently, it may be preferable to check or update this relationship in the context of maintenance of the hydraulic arrangement.

Moreover, the relationship generally also depends on the type of fluid used, and therefore the relationship is preferably redetermined or updated when the fluid for the hydraulic arrangement is changed, for example.

In general, it is possible to store the relationship for precisely one predetermined pressure. Whenever this pressure is reached, the temperature can be determined.

However, it is particularly preferred if the relationship, specific to the hydraulic arrangement, between the state variable and the temperature is determined for a plurality of predetermined pressures before initial commissioning of the hydraulic arrangement and/or in the context of maintenance of the hydraulic arrangement.

Accordingly, the temperature can be determined at different operating points of the hydraulic arrangement, in particular at different pressures.

In order to improve the accuracy of determination, it may be preferable to average the relationships, which are determined within a predetermined time segment of, for example, less than one minute and greater than one millisecond, at different pressures.

In this case, the predetermined pressures can correspond to regularly adopted predetermined operating points of the hydraulic arrangement, e.g. a fully closed friction clutch which is actuated by means of a piston/cylinder arrangement, wherein the port of the piston/cylinder arrangement is connected to the discharge port of the pump arrangement. As an alternative, it is possible to carry out temperature determination whenever one of the pressures happens to occur during the operation of the hydraulic arrangement, wherein this measurement principle is somewhat random.

As an alternative, it is also possible deliberately to select the predetermined pressure for temperature determination.

The accuracy with which the temperature can be determined by means of the method according to the invention can be so good that the temperature determined can be used in a control unit to control the hydraulic arrangement.

In an alternative or additional embodiment, the temperature determined can be used to check the operation of a temperature sensor which measures the temperature of the fluid.

While, in a preferred variant, no temperature sensor is therefore provided for measuring the temperature of the fluid, it is possible, in an alternative embodiment, to provide such a temperature sensor, wherein temperature detection according to the invention preferably takes place in order to check the operation of the temperature sensor, thus setting up a certain redundancy of temperature detection.

The state variable of the drive motor can be the power consumption of the drive motor, for example, but it can also be the voltage of the drive motor (in the form of a PWM signal, for example). Moreover, a combination of these two signals can be used to determine the temperature.

However, it is particularly preferred if the state variable of the drive motor is the rotational speed thereof.

The rotational speed of the drive motor is the state variable which is also used to adjust the pressure at the discharge port of the pump arrangement. Consequently, a higher accuracy can be achieved here. Moreover, the rotational speed of the drive motor is generally readily available in hydraulic arrangements according to the invention since a rotational speed sensor or the like is provided for this purpose in any case.

It is furthermore particularly preferred if the pressure of the fluid is regulated by adjusting the rotational speed of the drive motor.

It is thereby possible to achieve sensitive pressure feedback regulation.

In general, the leakage point via which the pump arrangement, in particular the discharge port thereof, is connected to the tank can be a leakage point inherent in the design or installation, e.g. a temperature-dependent leak in the pump arrangement itself (pumps often have such a leak owing to variable viscosity and/or variable gaps, and therefore said pumps have a falling volumetric efficiency as the temperature rises), but also the leakage of a rotary union or the like.

However, it is particularly preferred if the leakage point has an orifice plate, which is connected between the discharge port and the tank.

Admittedly, an idealized orifice plate is not dependent on temperature in its operation. However, real orifice plates tend to have the function of a restrictor since the length of the orifice plate cannot be infinitely short. In the case of all real or all industrial orifice plates, there is therefore a more or less pronounced temperature dependence.

An orifice plate of this kind is furthermore preferably used in the case of pump actuators of the type described above for the purpose of improving the controllability of the pressure at the discharge port of the pump arrangement, and therefore an orifice plate of this kind is preferably present in any case.

In the hydraulic arrangement according to the invention, it is preferable if the relationship between the state variable of the drive motor and the temperature of the fluid at a predetermined pressure of the fluid is stored in the form of a characteristic curve in the control unit. In the case of a plurality of predetermined pressures, a corresponding plurality of characteristic curves is stored in the control unit in the manner of a characteristic map.

As a result, temperature determination can be accomplished quickly and selectively since the characteristic curve or a stored table relating thereto in the control unit is directly accessed at a particular predetermined pressure.

As an alternative to a representation of a characteristic curve by a table, it is also possible to describe the characteristic curve as a function in the control unit, allowing the respective temperature value to be determined by calculation of the function equation. Since the relationship is preferably approximately linear, the function can be a linear function, which is approximated to the real profile of the relationship by approximation methods, for example.

The hydraulic arrangement according to the invention and the method according to the invention are preferably used in conjunction with motor vehicle transmissions, especially transmissions in which friction clutches or brakes are actuated by hydraulic actuators. For example, these can be converter-type automatic transmissions, automated shift transmissions, dual-clutch transmissions or continuously variable transmissions (CVT).

It is self-evident that the features mentioned above and those which remain to be explained below can be used not only in the respectively indicated combination but also in other combinations or in isolation without exceeding the scope of the present invention.

BRIEF DESCRIPTION OF THE SEVERAL VIEWS OF THE DRAWING

Illustrative embodiments of the invention are shown in the drawing and are explained in greater detail in the description which follows. In the drawing.

DETAILED DESCRIPTION OF PREFERRED EMBODIMENTS

Figure 1:
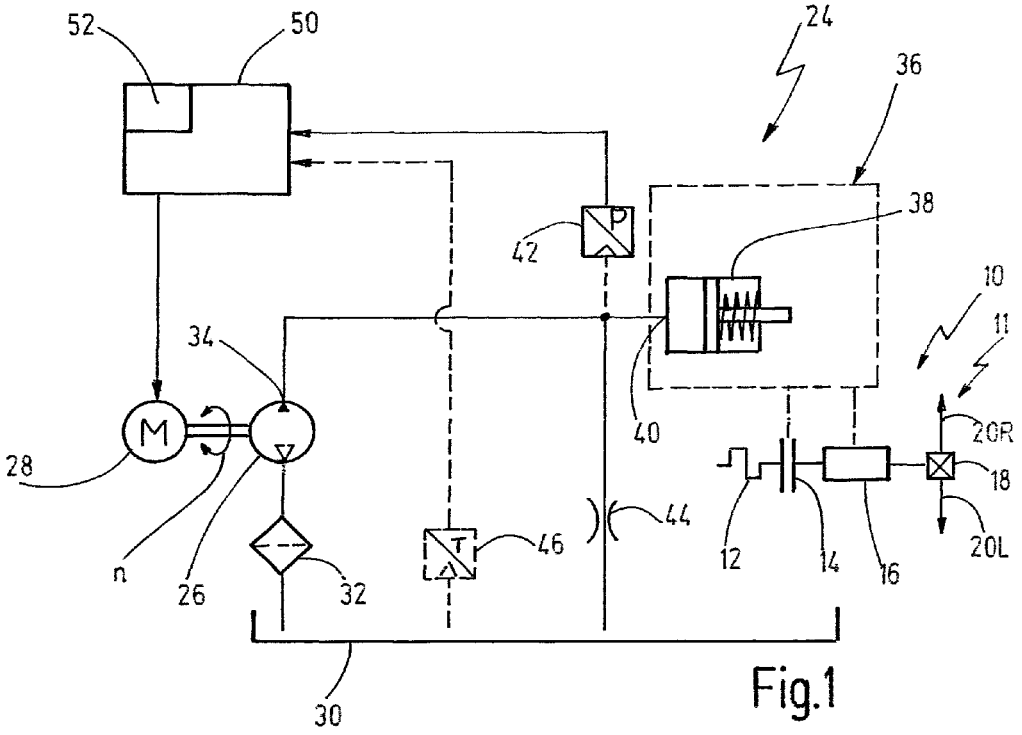
FIG. 1 shows a schematic illustration of a motor vehicle drive train having one embodiment of a hydraulic arrangement according to the invention.

A motor vehicle 10 having a drive train 11 is illustrated in schematic form in FIG. 1. The drive train 11 contains a vehicle motor 12, such as an internal combustion engine, a hybrid drive motor or the like. The drive train 11 furthermore has a friction clutch 14, the input of which is connected to the vehicle motor 12 and the output of which is connected to a transmission 16. An output of the transmission is connected to a differential 18, by means of which motive power is distributed between two driven wheels 20L, 20R.

The drive train 11 furthermore has a hydraulic arrangement 24, which, in the present case, is used for automatic actuation of the friction clutch 14. However, a hydraulic arrangement 24 of this kind can also be used for other assemblies in the drive train, e.g. for brakes in converter-type automatic transmissions, for adjusting continuously variable transmissions or the like.

In the case of dual-clutch transmissions, two such hydraulic arrangements are generally provided, one for each of the two friction clutches of the dual-clutch transmission.

The hydraulic arrangement 24 has a pump 26, which, in the present case, is designed as a unidirectional pump. The pump 26 is driven by means of a drive motor 28 in the form of an electric motor. The corresponding driving rotational speed is indicated at n. As an option, it is also possible for the pump 26 to be designed as a bidirectional pump, this being indicated in FIG. 1 by a dashed-line symbol in the pump 26.

An intake port of the pump 26 is connected to a tank 30, preferably via a fluid filter 32. The tank 30 is a region in which a fluid of the hydraulic arrangement is not under pressure. In the present case, the word "tank" is therefore any kind of reservoir or section of the hydraulic arrangement in which the fluid is present in substantially unpressurized form.

A discharge port 34 of the pump 26 is connected to a hydraulic load 36. In the present case, the hydraulic load 36 contains an actuator 38 in the form of a single-acting piston/cylinder arrangement. The hydraulic actuator 38 has a single actuator port 40, which is connected directly to the discharge port 34, i.e. without the interposition of pressure control valves or other proportional valves. If appropriate, directional control valves can be present in the connection between the discharge port 34 and the actuator port 40.

Also connected to the connecting line between the discharge port 34 and the actuator port 40 is a pressure sensor 42, which measures a pressure P of the fluid in said line. The discharge port 34 is furthermore connected to the tank 30 via an orifice plate 44.

An optional temperature sensor, which measures the temperature T of the fluid, e.g. in the region of the tank 30, is indicated at 46.

The drive train 11 furthermore has an electric or electronic control unit 50, which is connected to the pressure sensor 42. The control unit 50 is furthermore designed to control the drive motor 28, e.g. by means of a PWM signal. There can be a suitable power output element in the control unit, if required.

As an option, the control unit 50 is furthermore connected to the optional temperature sensor 46.

During operation, the friction clutch 14 is actuated by feed-back regulating the pressure P by adjusting the rotational speed n of the drive motor 28. As an alternative or in addition thereto, there can be a position sensor in the actuator 38 and/or in the friction clutch 14.

The temperature T of the fluid furthermore plays a part in the regulation and/or other functions of the hydraulic arrangement.

In the present case, at least one characteristic curve or table is stored in the control unit 50, representing the relationship between a state variable of the drive motor 28 and the temperature T of the fluid at a predetermined pressure P of the fluid (as indicated schematically at 52 in FIG. 1).

If the predetermined pressure is determined by the pressure sensor 42, the temperature T of the fluid can be determined by accessing the characteristic curve or table 52. Consequently, the temperature sensor 42 is not absolutely essential for the operation of the control unit 50 and can therefore be dispensed with. As an alternative, the temperature sensor 42 can be provided, in which case the temperature determination function via the characteristic curve or via the table 52 in the control unit 50 can be used to check the operation of the temperature sensor 42, in particular for reasons of redundancy.

The relationship between the state variable of the drive motor and the temperature is generally specific to each hydraulic arrangement owing to the various tolerances of the assemblies used in the hydraulic arrangement.

The state variable can be an electric variable of the drive motor but is preferably the rotational speed n of the drive motor.

Figure 2:
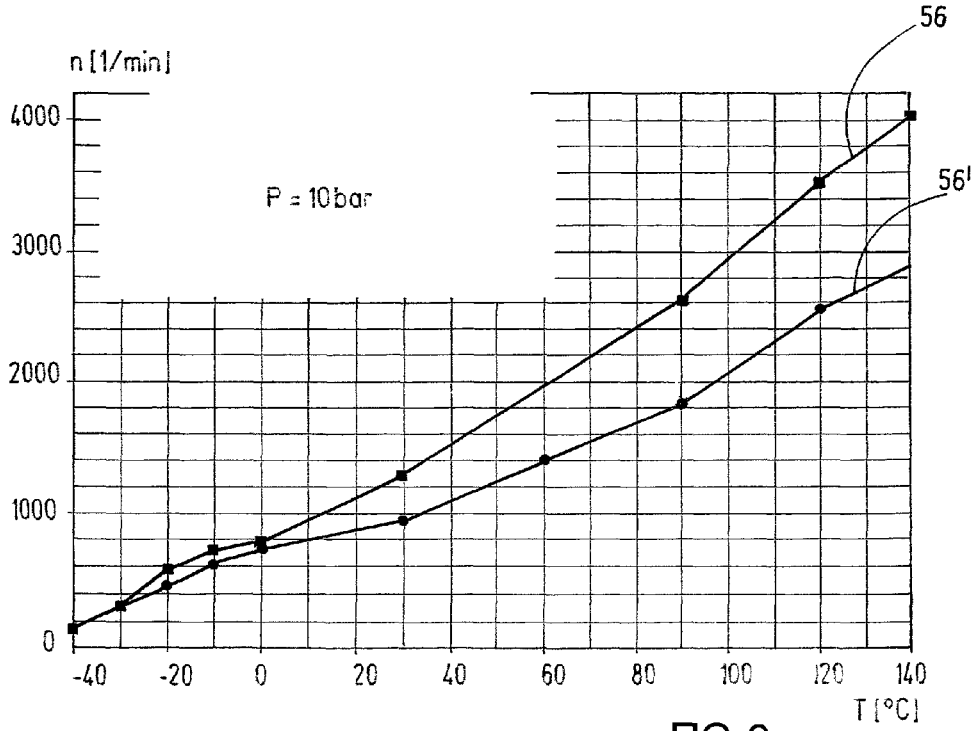
FIG. 2 shows two different relationships, specific to the hydraulic arrangement, between the rotational speed of a drive motor of a pump arrangement and the temperature of a fluid for a first predetermined pressure.
Figure 3:
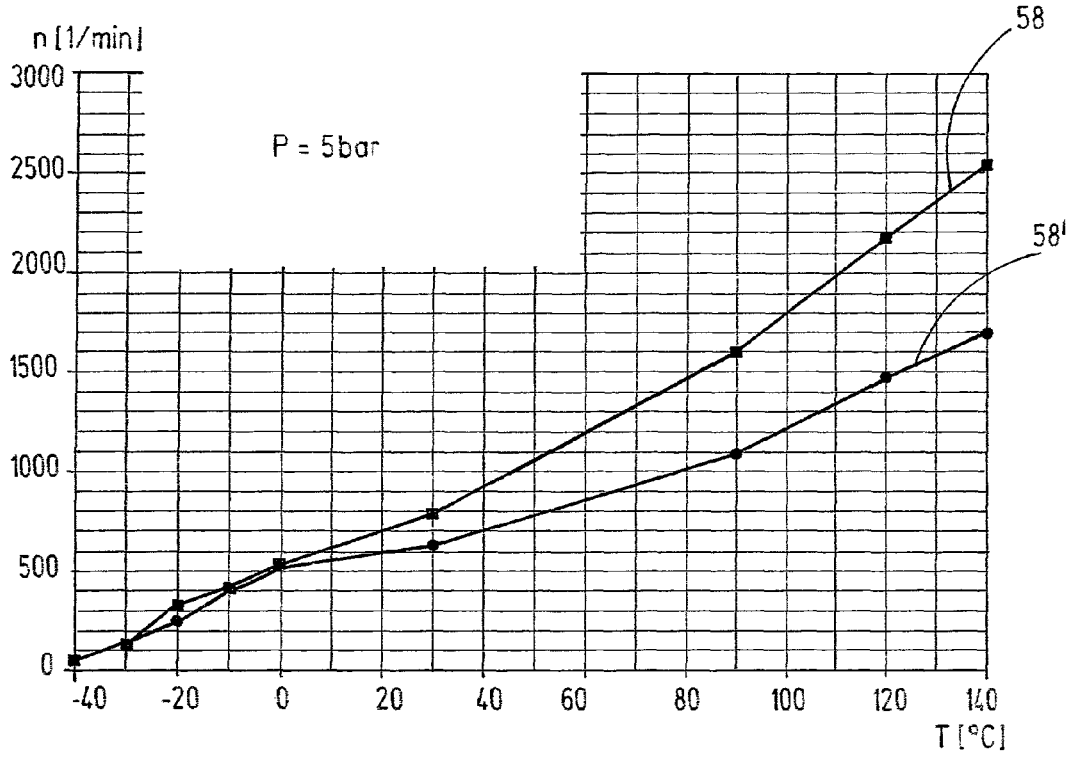
FIG. 3 shows an illustration corresponding to FIG. 2 for a second predetermined pressure.

Relationships of this kind are illustrated in FIGS. 2 and 3.

FIG. 2 shows the relationship in the form of a characteristic curve 56 between the rotational speed n of the drive motor 28 and the temperature T of the fluid at a predetermined pressure P of 10 bar for a particular hydraulic arrangement 24, more specifically at 56. At 56', this relationship is illustrated for a different hydraulic arrangement, in which the pump 26 has different axial play, for example.

Characteristic curve 56 (or 56') shows that the temperature T of the fluid is 90° C., for example, at a measured pressure P of 10 bar when it is necessary to operate the drive motor 28 at a rotational speed of 2600 revolutions in order to set this pressure of 10 bar. The temperature is furthermore 0° C., for example, when the drive motor has to be operated at a rotational speed of about 800 revolutions per minute in order to produce the pressure of 10 bar.

In the other hydraulic arrangement, which is associated with characteristic curve 56', the drive motor 28 is driven at a rotational speed of about 1800 revolutions per minute, for example, in order to achieve the pressure of 10 bar at a temperature of 90° C.

The characteristic curves can be determined when commissioning the hydraulic arrangement of the drive train. As an alternative or in addition thereto, these characteristic curves 56, 56' can be determined or updated during maintenance of the drive train and/or of the hydraulic arrangement 24.

In general, it is possible to carry out the temperature determination function of the type described above by means of a characteristic curve 56 of this kind whenever the predetermined pressure is present.

As an alternative, it is possible to store a plurality of such characteristic curves for a hydraulic arrangement, e.g. for different pressures. This is shown in FIG. 3.

The hydraulic arrangement with which the characteristic curve 56 in FIG. 2 is associated has a characteristic curve 58 at a pressure of P=5 bar, where the temperature is 90° C., for example, when the drive motor is driven at about 1600 revolutions/minute. The other hydraulic arrangement has a characteristic curve 58' for the same pressure of P=5 bar where the drive motor 28 is driven at a rotational speed of about 1200 revolutions/minute, for example, when the temperature T=90° C.

The invention claimed is:

1. A method for assessing the determination of temperature in a hydraulic arrangement having variability, the hydraulic arrangement operating in conjunction with a motor vehicle drive train and the hydraulic arrangement operating a hydraulic load comprising an actuator involved with one of a friction clutch, brake system or continuously variable transmission arrangement, wherein the hydraulic arrangement comprises:

an electric drive motor;

a pump driven by the electric drive motor for pumping a fluid, the pump having an input port and a discharge port;

a tank connected to the pump through the input port;

a pressure sensor situated in a discharge line, the discharge line fluidly connecting the discharge port with the actuator;

a leakage point connecting the discharge line with the tank;

a control unit connected to the pressure sensor and electric drive motor, the control unit adjusting the rotational speed of the electric drive motor based on pressure feedback from the pressure sensor such that the actuator is actuated in a desired manner; wherein the control unit is further configured to control the electric drive motor by way of at least one characteristic curve or table stored in the control unit, the characteristic curve or table representing relationships between a state variable of the electric drive motor and the temperature of the fluid at predetermined pressures of the fluid; wherein the characteristic curve or table at least possesses one relationship between the state variable and temperature at a first predetermined pressure and an additional relationship between the state variable and temperature at a second predetermined pressure; wherein the method of assessing the determination of temperature in a hydraulic arrangement having variability comprises:

determining relationships, specific to the hydraulic arrangement having variability, between the state variable of the electric motor and temperature, and checking or updating these relationships in the context of maintenance of the hydraulic arrangement.

2. Method according to claim 1, wherein a temperature determined from the at least one characteristic curve or table is used in the control unit to control the hydraulic arrangement.

3. Method according to claim 2, wherein the temperature determined is used to check the operation of a temperature sensor which measures the temperature of the fluid.

4. Method according to claim 1, wherein the state variable of the electric drive motor is the rotational speed thereof.

5. Method according to claim 1, wherein pressure of the fluid is regulated by adjusting the rotational speed of the electric drive motor.

6. Method according to claim 1, wherein the leakage point has an orifice plate, which is connected between the discharge port and the tank.

7. Method according to claim 1, wherein the leakage point comprises a leak in the hydraulic arrangement.

8. The method according to claim 1, wherein the method includes the step of:

receiving, at the control unit, measured pressure of the fluid from the pressure sensor.

9. The method according to claim 1, wherein the leakage point is implemented by means of an orifice plate.

* * * * *